US010378171B2

(12) United States Patent
Maersch et al.

(10) Patent No.: US 10,378,171 B2
(45) Date of Patent: Aug. 13, 2019

(54) METHOD AND APPARATUS FOR IMPROVED INSTALLATION OF CAISSONS

(71) Applicant: American Transmission Company LLC, Waukesha, WI (US)

(72) Inventors: Todd Maersch, Madison, WI (US); Jim Jacobi, Wautoma, WI (US); Brent Lund, Woods Cross, UT (US); Matt Atkinson, Madison, WI (US); Tyler Morgan, Fort Wayne, IN (US); Hock Lim, Fort Worth, TX (US)

(73) Assignee: American Transmission Company LLC, Waukesha, WI (US)

( * ) Notice: Subject to any disclaimer, the term of this patent is extended or adjusted under 35 U.S.C. 154(b) by 0 days.

(21) Appl. No.: 15/603,912

(22) Filed: May 24, 2017

(65) Prior Publication Data

US 2018/0087232 A1 Mar. 29, 2018

Related U.S. Application Data

(60) Provisional application No. 62/400,455, filed on Sep. 27, 2016.

(51) Int. Cl.

| | |
|---|---|
| ***E02D 5/28*** | (2006.01) |
| ***E02D 7/18*** | (2006.01) |
| ***E02D 13/02*** | (2006.01) |
| ***E02D 7/28*** | (2006.01) |
| ***E02D 5/22*** | (2006.01) |
| ***E02D 13/00*** | (2006.01) |
| ***E04H 12/22*** | (2006.01) |
| *E02F 3/30* | (2006.01) |

(Continued)

(52) U.S. Cl.

CPC ..... *E02D 7/28* (2013.01); *E02D 5/223* (2013.01); *E02D 13/00* (2013.01); *E04H 12/2215* (2013.01); *E04H 12/2276* (2013.01); *E02F 3/308* (2013.01); *E02F 9/2271* (2013.01); *E04H 12/08* (2013.01)

(58) Field of Classification Search

CPC .. E02D 5/22; E02D 5/223; E02D 5/24; E02D 5/28; E02D 7/00; E02D 7/18; E02D 7/28; E02D 13/00; E02D 13/10; E04H 12/08; E04H 12/2215; E04H 12/2276

USPC ..... 405/231, 232, 249, 255

See application file for complete search history.

(56) References Cited

U.S. PATENT DOCUMENTS 3,241,326 A * 3/1966 Guild ..... E02D 13/00 173/132

4,472,085 A * 9/1984 Mohler ..... E02D 13/10 173/132

(Continued)

*Primary Examiner* — Benjamin F Fiorello

*Assistant Examiner* — Stacy N Lawson

(74) *Attorney, Agent, or Firm* — Boyle Fredrickson, S.C.

(57) ABSTRACT

A caisson is modified to include side tabs thin can be gripped by side-mounted clamps on a vibratory hammer so that the caisson may be lifted into position from a horizontal position, oriented vertically, and driven into the ground without readjustment of the clamping of the vibratory hammer. An end cap installed permanently at the top of the caisson may provide an additional flange for receiving a lower clamp of the vibratory hammer to complete installation of the caisson, driving the caisson further into the earth until the tabs are buried in the ground. The flange may be sized to fit within a tower portion attached to the caisson eliminating the need for a replaceable flange system.

12 Claims, 5 Drawing Sheets

(51) Int. Cl.
*E02F 9/22* (2006.01)
*E04H 12/08* (2006.01)

(56) References Cited

U.S. PATENT DOCUMENTS 6,390,734 B1 * 5/2002 Marshall ..... E02D 27/14
405/230
6,722,821 B1 * 4/2004 Perko ..... E02D 5/801
405/249
8,371,771 B1 * 2/2013 Lugo ..... E02D 5/80
405/227
2005/0074298 A1 * 4/2005 Jones ..... E02D 5/523
405/252.1
2005/0163616 A1 * 7/2005 Mortensen ..... E02B 17/00
416/132 B
2006/0088388 A1 * 4/2006 Wissmann ..... E02D 3/08
405/232
2012/0114425 A1 * 5/2012 Seider ..... E02D 5/523
405/252.1
2016/0218659 A1 * 7/2016 Matsuyama ..... H02S 20/10

* cited by examiner

METHOD AND APPARATUS FOR IMPROVED INSTALLATION OF CAISSONS

CROSS REFERENCE TO RELATED APPLICATION

This application claims the benefit of U.S. provisional application 62/400,455 filed Sep. 27, 2016 and hereby incorporated by reference.

BACKGROUND OF THE INVENTION

The present invention relates to earth-supported hollow piles ("caissons"), for example, as are used as foundations for towers and the likes and in particular to a caisson providing reduced installation time and cost.

Construction projects, for example, those routing high-voltage electrical transmission lines, may require placement and setting of a large number of towers to support high voltage electrical conductors safely above the ground free from interference. The foundations for these towers may be provided by tubular steel caissons embedded in the ground to be supported by the surrounding earth. The tubular form of these caissons provides for great strength and the open lower ends offer low resistance to the caisson being driven downward through the earth which may pass along the inside and outside of the tubular steel walls. Accordingly, when soil conditions are right, caissons are normally installed by driving them directly into the earth without first preparing a hole.

Driving caissons directly into the ground may be done with a vibratory hammer applying a rapid series of high force impacts to the top of the caisson typically through a specially installed protective cap fitting over the caisson end. The vibratory hammers have internal eccentric weights, for example, driven by a hydraulic motor and have a hydraulic clamp that may clamp the vibratory hammer tightly to the protective cap and caisson to directly couple forces from the vibratory hammer into the caisson walls. The vibratory hammers are normally associated with a large weight providing an inertial backstop against which the hammer may operate. This weight is coupled to the vibratory hammer with an asymmetric elastomeric coupling that promotes high downward forces yet attenuated upward forces so that the net progress of the caisson moves downward during vibration.

The current process for installing a caisson using a vibratory hammer may require a crew to install the protective cap on the caisson and an on-site crane to lift the caisson into vertical orientation. A second crane holding the vibratory hammer may then be positioned above the caisson and clamped to the protective cap to drive the caisson into the earth. The protective cap is then removed and the tower installed on the portion of the caisson projecting above the ground. This process is repeated for each caisson to be installed with a typical project requiring many hundreds of caissons.

SUMMARY OF THE INVENTION

The inventors have determined that properly designed side tabs can be added to large caissons to permit vibratory forces to be effectively transferred from an offset position to a side of the caisson through the tabs into the caisson. The availability of these tabs permits the caisson to be installed with greatly reduced time and labor necessary by using the vibratory hammer to both position the caisson (by gripping the side tabs and lifting the caisson when the caisson is on the ground) and to drive the caisson into the earth without the need for separate equipment or repositioning of the vibratory hammer.

In one embodiment, the caisson has a preinstalled protective cap allowing the vibratory hammer to clamp a flange on the cap to complete the driving of the caisson into the ground burying the side tabs. The flange on the protective cap may be sized to fit within a tower portion ultimately attached to the caisson after completion of the driving process, thus allowing the cap to be permanently attached to the caisson further eliminating the steps of field installation and removal.

In one embodiment, the invention provides a caisson for vibratory installation having a caisson body providing a rigid tubular wall extending along an axis and open at a bottom end and having a cross-sectional area greater than two square feet. The caisson includes at least one tab passing diametrically through the rigid tubular wall perpendicular to the axis, and attached to the caisson body at opposite walls, the tab extending outward from the tubular wall on at least one side by a predetermined clamping distance sized to be received by clamp jaws of a vibratory caisson driver.

It is thus a feature of at least one embodiment of the invention to provide side tabs on a caisson that can be used both for positioning and driving the caisson from an offset position, eliminating the need for repositioning of the vibratory hammer or a separate crane for lifting the caisson.

The caisson, may provide two tabs passing diametrically through the rigid tubular wall perpendicular to the axis and attached to the caisson body at opposite walls, the two tabs extending outward from the tubular wall on at least one side by the predetermined clamping distance and axially separated and axially aligned to be separately clamped by corresponding axially spaced clamp jaws of the vibratory caisson driver.

It is thus a feature of at least one embodiment of the invention to provide sufficient tab area to allow high forces to be transferred through the clamping jaws of currently available vibratory hammers from an offset position.

The two tabs may be joined by a bridging element lying within a plane of the tabs and passing through the walls of the caisson to be welded thereto.

It is thus a feature of at least one embodiment of the invention to cross brace the tabs for greater strength and to provide an increased axial weld surface between the tabs and the caisson for better three coupling and resistance to caisson damage.

At least one tab may pass diametrically through the rigid tubular wall perpendicular to the axis to attach to the caisson body at opposite walls and to extend outward from the tubular wall on opposite sides of the caisson by the predetermined clamping distance.

It is thus a feature of at least one embodiment of the invention to increase the accessibility of tabs to the vibratory hammer when the caissons are in arbitrary positions on the ground.

The caisson may further include a reinforcing flange attaching to the rigid tubular wall at an area adjacent to the extension of the tab outward from the tubular wall to connect to the tab and the tubular wall.

It is thus a feature of at least one embodiment of the invention to distribute the high shear forces imposed on the tabs over the wall of the caisson to prevent damage thereto.

The predetermined clamping distance may be at least six inches.

It is thus a feature of at least one embodiment of the invention to provide adequate clamping area to transfer forces from the vibratory hammer in an offset position into the caisson body.

The tab may be a plate having its narrowest dimension perpendicular to the axis of the caisson.

It is thus a feature of at least one embodiment of the invention to provide a simple protruding structure that can be easily driven into the earth and out of the way when the caisson is fully seated.

The tab may include a stop member attached to an outer end to project laterally with respect to an axis of the tab projection from the caisson.

It is thus a feature of at least one embodiment of the invention to provide a tab that enforces close placement of the vibratory hammer jaws to the caisson body and that prevents slippage when the caisson is being lifted from the ground.

The stop member may be a plate having a narrowest dimension of less than ¾ inch.

It is thus a feature of at least one embodiment of the invention to provide an easily fabricated stop element that can ultimately also be driven into the earth with low resistance.

The caisson may further provide an end cap attached to an upper end of the caisson and providing an upwardly extending flange for receiving clamp jaws of a vibratory caisson driver.

It is thus a feature of at least one embodiment of the invention to permit the caisson to be driven to a depth below that possible with side tabs alone.

The flange may be sized to fit within the diameter of a tower attaching to the end cap.

It is thus a feature of at least one embodiment of the invention to permit the flange to be permanently attached to the caisson eliminating the need for separate attachment and detachment steps.

Generally, the invention enables a method installing caissons using the steps of: employing an arm-mounted vibratory hammer to grip the tab on a caisson lying on the ground; moving the arm-mounted vibratory hammer to lift the caisson into a vertical position; and drive the caisson into the ground using vibrations from the vibratory hammer conducted through the tab from an offset position next to the caisson.

It is thus a feature of at least one embodiment of the invention to greatly simplify the installation of caissons by reducing the need for separate placement and driving equipment and operators and allowing positioning and initial driving of the caisson without repositioning of the vibratory hammer.

In one embodiment, the method may include the step of releasing the vibratory hammer from the tab and gripping the flange to drive the caisson further into the ground to bury the tab.

It is thus a feature of at least one embodiment of the invention to allow full seating of the caisson in the ground covering the tabs using a common vibratory hammer design.

These particular objects and advantages may apply to only some embodiments falling within the claims and thus do not define the scope of the invention.

DETAILED DESCRIPTION OF THE PREFERRED EMBODIMENT

Figure 1:
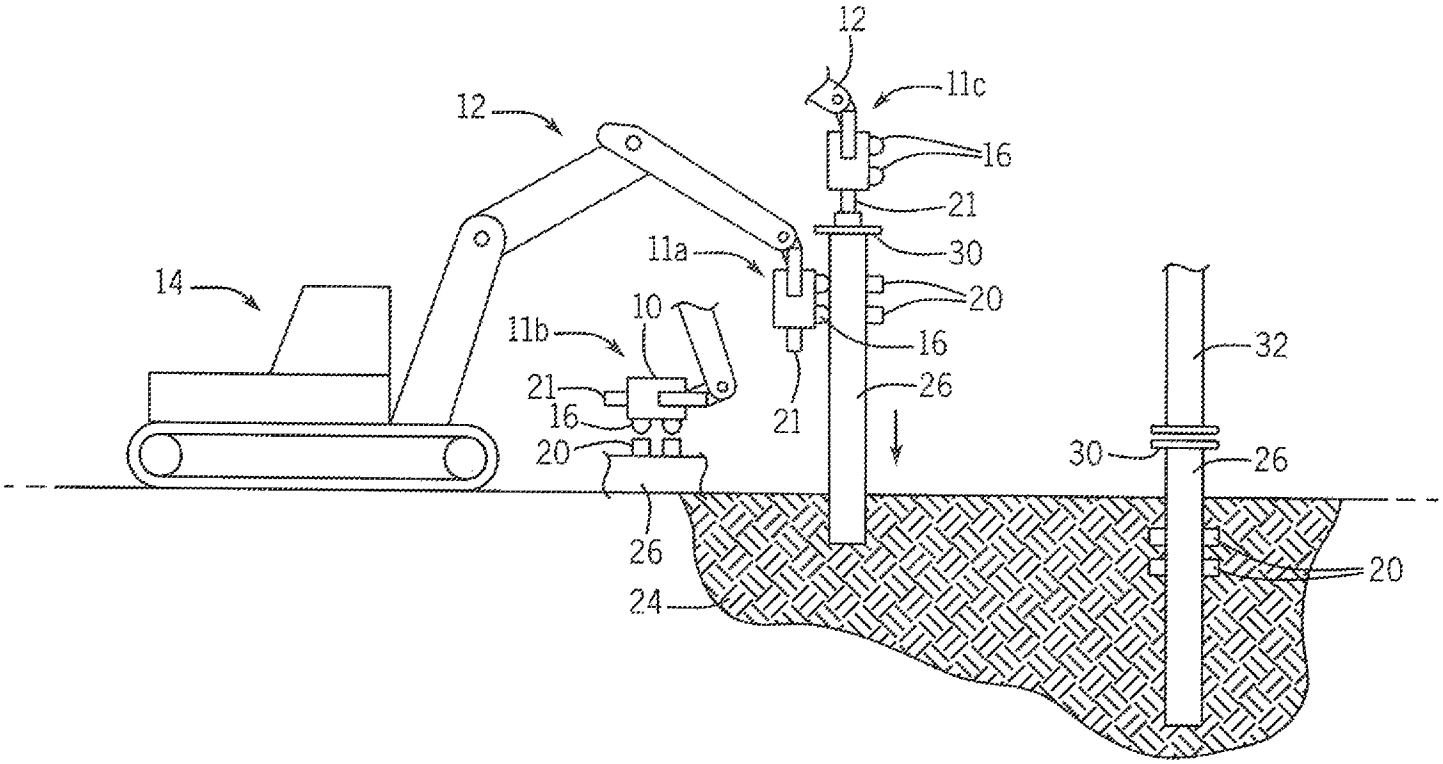
FIG. 1 is a simplified diagram of an excavator-mounted vibratory hammer lifting a caisson by gripping side tabs on a caisson, using those same side tabs to drive the caisson into the ground, and then repositioning the vibratory hammer on a special end cap to drive the side tabs beneath the ground.
Figure 4:
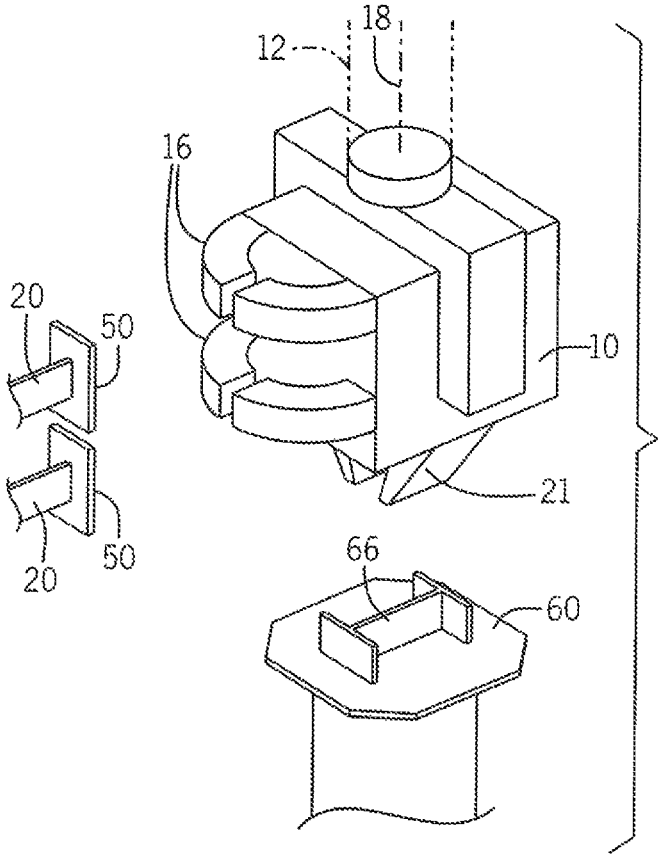
FIG. 4 is a simplified diagram of a vibratory hammer providing side and bottom clamping capabilities.

Referring now to FIG. 1, a system for installing caissons into the earth may employ a vibratory hammer 10 supported on the end of an articulated arm 12 of an excavator 14 or the like. Referring also to FIG. 4, the vibratory hammer 10 may provide for upper and lower side clamps 16 displaced along a hammer axis 18 defining a direction of force applied by the vibratory hammer during a driving operation and extending perpendicularly to that hammer axis 18. Each of the side clamps 16 may open and close across a plane aligned with the hammer axis 18 in a clamping direction perpendicular to that plane, for example, as actuated by hydraulic cylinders (not shown).

In addition, the vibratory hammer 10 may provide a hydraulically actuated lower clamp 21 extending downward along the hammer axis 18 also opening and closing in a direction perpendicular to the hammer axis 18.

Referring particularly to FIG. 1, the vibratory hammer 10 may be mounted to the excavator arm 12 so as to be movable in elevation above the ground with the hammer axis 18 vertical (shown by position 11*a*) and rotated to move the hammer axis 18 to a horizontal position (shown by position 11*b*) with the side clamps 16 facing downward and to rotate the vibratory hammer 10 about the hammer axis 18. This motion may be provided by actuator control of a joint between the arm 12 and the vibratory hammer 10 or articulation of the arm 12 or movement of the excavator 14 as is generally understood in the art.

As so mounted on the arm 12, the vibratory hammer 10 is first positioned above a caisson body 26 lying on the ground in position 11*b* so that the side clamps 16 may grip tabs 20 extending from a side wall of the caisson body 26. Combined movement of the arm 12 and rotation of the vibratory hammer 10 may then be used to lift the caisson body 26 into a vertical orientation with the vibratory hammer in position 11*a* and still gripping the tabs 20 in the side clamps 16. Finally, without release of the tabs 20 gripped by the side clamps 16 of the vibratory hammer 10, the vibratory hammer 10 may be activated to drive the caisson body 26 into the earth 24 using vibratory forces conducted through the tabs 20 into the caisson body 26 from the vibratory hammer 10 offset to the side of the caisson body 26.

Referring still to FIG. 1, the caisson body 26 may be driven into the earth 24 with the vibratory hammer 10 moving downward along a straight-line path without rotation until the vibratory hammer 10 is proximate to the surface of the earth 24. At that point, the side clamps 16 of the vibratory hammer 10 may be released and the vibratory hammer 10 moved to position 11*c* where the lower clamp 21 of the vibratory hammer 10 may engage an upper flange 28 on a protective end cap 30 at the upper end of the caisson body 26. In this position, the vibratory hammer 10 may be activated again to transmit vibrations through the end cap 30 continuing to drive the caisson body 26 into the ground until the tabs 20 are buried in the earth 24.

At this point, the vibratory hammer 10 may be removed by releasing the lower clamp 21 and a tower 32 may be installed on the end cap 30, for example, by a bolt ring completing the installation of the tower 32 on the foundation provided by the caisson body 26.

Figure 2:
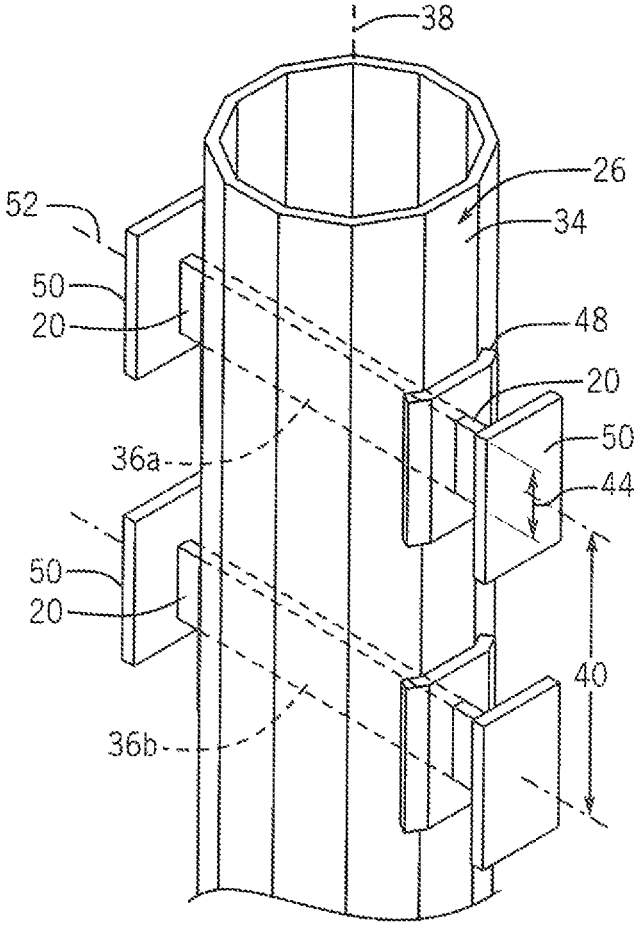
FIG. 2 is a fragmentary perspective view of a caisson providing axially spaced tabs on opposite sides of the caisson body for gripping in two orientations.

Referring now to FIG. 2, the caisson body 26 may provide far a cylindrical tubular wall 34, for example, ranging from 18 inches in diameter to several feet or more. Typically, the caisson body 26 will be formed from rolled plate steel, for example, having a thickness from 5/16 to 3/4 of an inch depending on the diameter of the caisson body 26. A caisson having a polygonal cross-section is shown; however, the invention also works with circular and tube shapes.

An upper end of the cylindrical tubular wall 34 may be pierced by upper and lower tab plates 36*a* and 36*b* passing diametrically through the caisson body 26 generally perpendicular to a caisson axis 38. The upper and lower tab plates 36*a* and 36*b* are generally parallel and spaced apart along the axis 38 by a distance 40 defined by a separation of the upper and lower side clamps 16 of the vibratory hammer 10.

Figure 3:
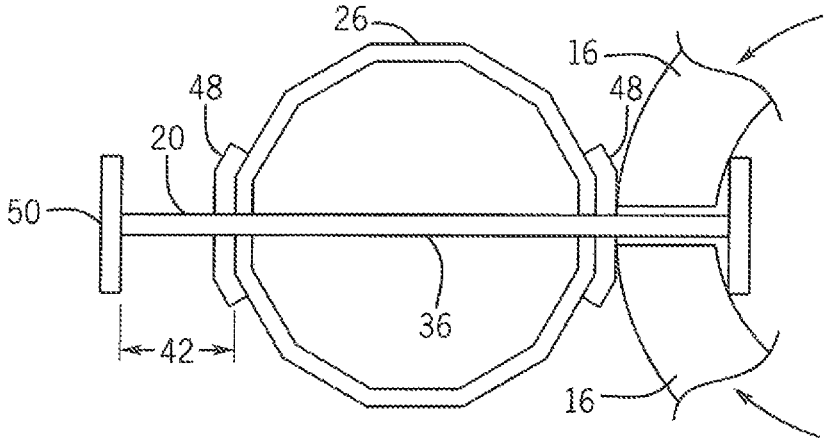
FIG. 3 is a top plan view of the caisson of FIG. 2 showing a sizing of the tabs to receive jaws of the vibratory hammer.

Referring also to FIG. 3, the tab plates 36 may extend from opposite sides of the caisson body 26 by a distance 42, these extensions provide that the tabs 20 are accessible at the outer wall of the caisson body 26 on each side of the caisson body 26. The distance 42 will be set to closely equal a minimum distance required to receive the side clamps 16 to clamp about the exposed portion of each tab 20, ensuring that the side clamps 16 are positioned as close as possible to the caisson body 26. Normally the extension will be approximately eight inches and no less than six inches.

The height 44 of each tab 20 may also be dictated by the size of the side clamps 16 so as to provide a surface large enough to fully contact the entire clamping face of the side clamps 16. In this case, there is no need to limit the dimension which may be in excess of eight inches.

Each tab plate 36 and tab 20 will normally have its thinnest dimension (the thickness of the plate) mutually aligned and oriented perpendicularly to the axis 38 to define a planar clamping surface that may be engaged by the side clamps 16 and to provide minimal earth resistance when they are driven into the ground. The tab plates 36 may, for example, be 3/16-inch thick steel but will generally be less than 3/4 of an inch in thickness while providing sufficient strength.

The tab plates 36 may pass through rectangular slots cut in the sidewalls of the caisson body 26 and the area around the slots may be reinforced with a reinforcing plate 46. The reinforcing plate 48 also includes a slot, so that it may surround the tab 20 as the tab plate 36 exits from the caisson body 26 thereby providing an increased length of weld to the tab 20 to fully support the tab 20. The reinforcing plate 48 may be formed to conform with the outer surface of the caisson body 26 at the point of exit of the tab plates 36 and may be welded around its periphery to the outer surface of the caisson body 26 to provide a transfer of force from the vibratory hammer through the tab 20 into the reinforcing plate 48 and then to a broad area of the caisson wall to permit high forces to be applied to the tab 20 without damage or buckling of the wall of the caisson body 26.

Referring still to FIGS. 2 and 3, stop elements 50 may be placed on the distal ends of the tabs 20 to reduce the possibility that the caisson body 26 held by the vibratory hammer 10 with its, side clamps 16 on the tabs 20 will slip from the grip of the side clamps 16. In one embodiment, the stop elements 50 may be steel plates butt welded to the distal ends of the tabs 20 extending in a plane perpendicular to an axis 52 defining an extent of the tabs 20 so as to extend outward on opposite, sides of the broad face of the tabs 20. As so positioned, the stop elements 50 may engage an inner side of the side clamps 16 when the side clamps 16 are closed to prevent such slippage. The stop element 50 may be fashioned from plate steel having a thickness comparable to the thickness of the tab plates 36 so as to easily pass into the ground as the caisson body 26 is driven into the earth 24

Figure 5:
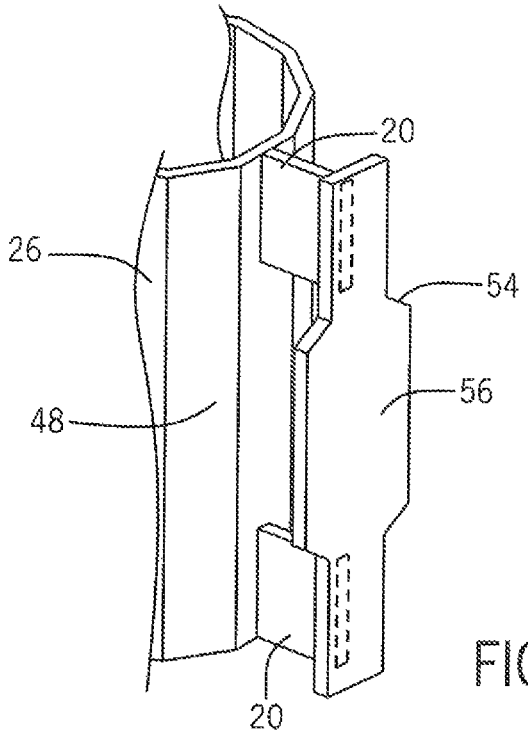
FIG. 5 is an alternative embodiment in which a stop element bridges two axially spaced tabs for improved reinforcement.

Referring now to FIG. 5, in an alternative embodiment, the stop element 50 of FIG. 2 may be extended between the tabs 20 on each side of the caisson body 26 as a bridging stop 54 interconnecting the distal ends of the upper and lower tab 20 to provide additional reinforcement between the tabs 20. Again, the stop 54 may be, a plate extending perpendicularly to the direction of the extension of the tabs 20 butt-welded to the ends of the tabs 20. A center portion 56 of the stop 54, such as does not interfere with the side clamps 16, may be wider for additional strength.

Figure 6:
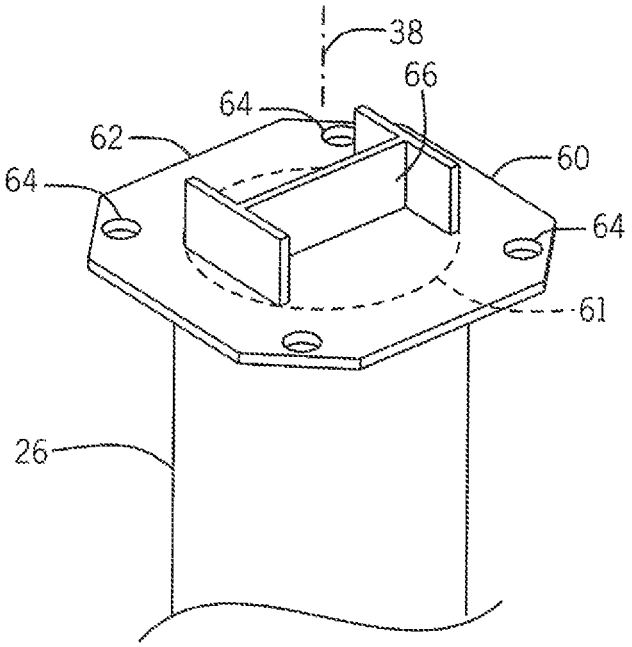
FIG. 6 is a fragmentary perspective view of an upper end of a caisson having an end cap providing a flange for coupling to the vibratory hammer of FIG. 4 for final installation.
Figure 7A:
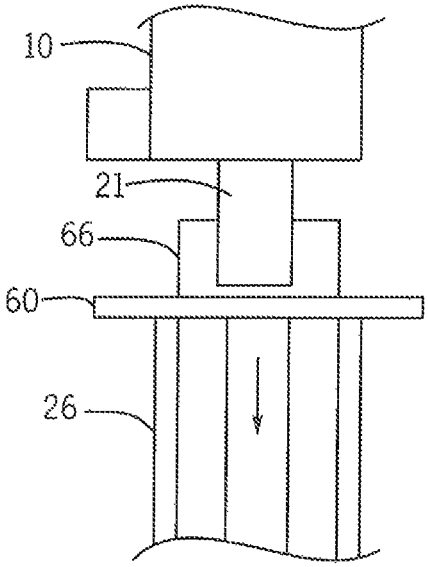
FIGS. 7*a*-7*b* are figures showing positioning of the hammer on the flange of FIG. 6 for completion of the driving process and attachment of a tower portion to the end cap without removal of the flange.

Referring now to FIG. 6, optionally a bolt plate 60 may be installed on the upper end of the caisson body 26, for example, by welding, to provide a flange surface 62 extending generally perpendicularly to the axis 38 of the caisson body 26. This flange surface 62 will extend outside of a radius 61 of the caisson body 26 and an inner diameter of a subsequent tower portion to be installed, on the caisson body 26 thereby providing access to bolt holes 64 arranged around the outer edge flange surface 62 outside of the radius 61. Positioned centered within the radius 61 is an upwardly extending flange 66, for example, being the center web of an I-beam welded to the flange surface 62 and extending upward therefrom. Referring now to FIG. 7*a*, this flange 66 may be gripped by lower clamp 21 of the vibratory hammer 10 at position 11*c* shown in FIG. 1 so that the caisson body 26 may be driven further into the ground to a distance where the tabs 20 are buried.

Figure 7B:
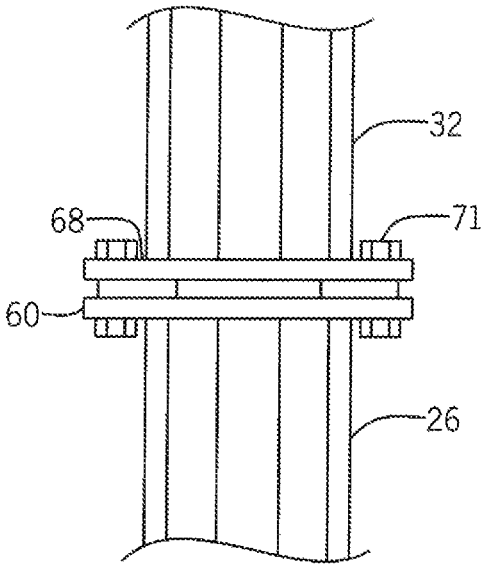

Referring also to FIG. 7*b*, preferably the flange 66 is sized to fit within a hollow center portion of the tower 32 attached to the caisson body 26 when the tower 32 is installed on the bolt plate 60, for example, using a corresponding flange 68 attached to the tower 32 and multiple bolts 71. In this way, that the bolt plate 60 flange surface 62 may be permanently installed on the caisson body 26 and need not be removed or modified for installation of the tower 32 on top of the plate 60, further reducing installation time and effort.

Figure 8:
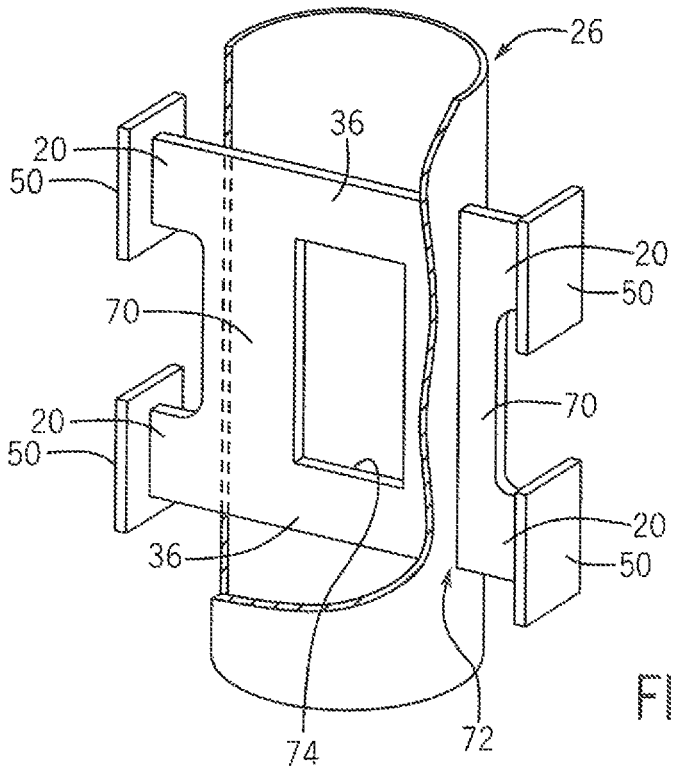
FIG. 8 is a fragmentary partial cutaway of a caisson using a bridging, design providing additional support between the tabs and the caisson wall.
Figure 9:
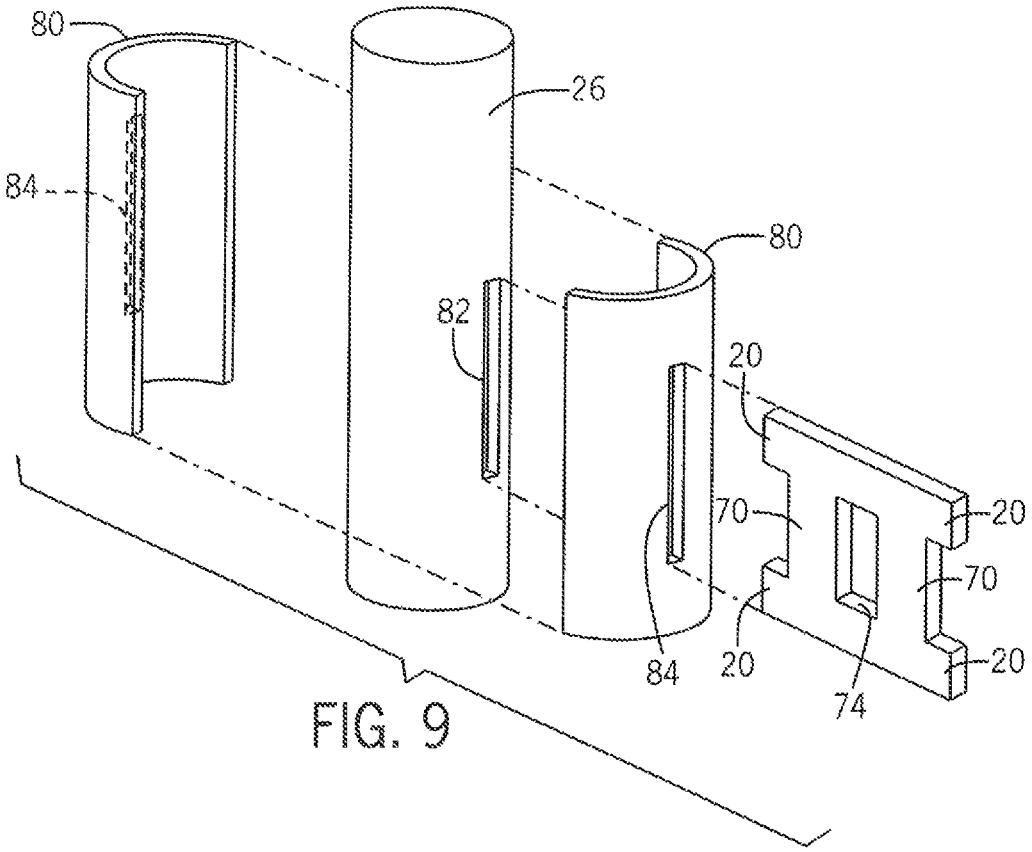
FIG. 9 is a figure showing the bridging design used with extended reinforcing plates.

Referring now to FIGS. 8 and 9, in an alternative embodiment, the axially separated tabs 20 may be joined by a bridging element 70, for example, formed of the same plate such as firms the tab plates 36 and generally coplanar with the tab plates 36. This bridging element 70 may also pass through the wall of the caisson body 26 and may be welded thereto as indicated by weld line 72 thus providing both greater resistance to buckling of the caisson wall axially and greater weld interface. The bridging element 70 may stop after it passes through the wall of the caisson body 26 to provide a cutout region 74 for weight reduction. As shown in FIG. 9, further reinforcement may be obtained through the use of extended width reinforcement sleeves 80, for example, each conforming to the outer surfaces of the caisson body 26 over approximately half the periphery of the caisson body 26 surrounding the slot 82 through which the bridging element 70 and tabs 20 pass with corresponding slots 84. Again, the reinforcement sleeves 80 may be welded at their edges to the caisson body 26 to provide a broad area contact between these elements.

The invention contemplates that in some embodiments tabs 20 may not extend from both sides but only from one side of the caisson body 26. In this case, the tab plates 36 may pass through both or only one side of the caisson body 26 to be welded to corresponding slots at both sides of the caisson body 26 or to one slot and an interior surface of the caisson body 26. The invention further contemplates that the two axially separated tabs as depicted in FIG. 2 may be replaced with a single tab (extending either from one or both sides of the caisson body 26), sized to be received by both side clamps 16 of the vibratory hammer 10 for a single jaw of larger size.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention, not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. A caisson for vibratory installation comprising:

a caisson body providing a rigid tube extending along an axis between a top end and a bottom end and open at the bottom end and having a cross-sectional area greater than two square feet, the tube having opposed tube walls;

a first tab removed from the top end and passing diametrically through a first of the opposed tube walls perpendicular to the axis and attached to the caisson body at the opposed tube walls, the first tab extending outward from the caisson body by a predetermined clamping distance sized for the first tab to be received by clamp jaws of a vibratory caisson driver;

a second tab removed from the top end and passing diametrically through the first opposed tube wall perpendicular to the axis and attached to the caisson body at the opposed tube walls, the second tab extending outward from the caisson body by a predetermined clamping distance sized for the second tab to be received by the clamp jaws of the vibratory caisson driver; and further including at least one stop member attached to an outer end of the first tab and second tab to project outward from a plane of projection of the tabs from the caisson body;

wherein the first and second tabs are positioned between the top end and bottom end to permit the vibratory caisson driver receiving the first tab and second tab within the clamp jaws at only one side of the caisson body to raise the caisson from a horizontal position to a vertical position and drive the caisson into the ground without repositioning of the vibratory caisson driver; wherein the first and second tabs are fixedly attached to the caisson body at the opposed tube walls so as to transfer force from the vibratory caisson driver through the tabs to the caisson body to drive the caisson into the ground.

2. The caisson of claim 1 wherein the predetermined clamping distances are each at least six inches.

3. The caisson of claim 1 wherein each of the tabs is a plate having its narrowest dimension perpendicular to the axis of the caisson body.

4. The caisson of claim 1 wherein the stop member is a plate having a narrowest dimension of less than ¾ inch.

5. The caisson of claim 1 wherein the first and second tabs pass diametrically through the rigid tube perpendicular to the axis to attach to the caisson body at opposite sides and to extend outward from the caisson body on the opposite sides of the caisson body by the predetermined clamping distances.

6. The caisson of claim 5 further wherein the at least one stop member includes stop members attached to opposite outer ends of the first and second tabs to project laterally with respect to an axis of projection of the tabs from the caisson body.

7. The caisson of claim 1 further including an end cap attached to the top end of the caisson body and providing an upwardly extending flange for receiving the clamp jaws of the vibratory caisson driver.

8. The caisson of claim 7 wherein the flange is sized to fit within a diameter of a tower adapted to be attached to the end cap.

9. A caisson for vibratory installation comprising:

a caisson body providing a rigid tube extending along an axis between a top end and a bottom end and open at the bottom end and having a cross-sectional area greater than two square feet, the tube having opposed tube walls;

a first tab removed from the top end and passing diametrically through a first of the opposed tube walls perpendicular to the axis and attached to the caisson at the opposed tube walls, the first tab extending outward from the caisson body by a predetermined clamping distance sized for the first tab to be received by clamp jaws of a vibratory caisson driver;

a second tab removed from the top end and passing diametrically through the first opposed tube wall perpendicular to the axis and attached to the caisson body at the opposed tube walls, the second tab extending outward from the caisson body by a predetermined clamping distance sized for the second tab to be received by the clamp jaws of the vibratory caisson driver; and further including at least one stop member attached to an outer end of the first tab and second tab to project outward from a plane of projection of the tabs from the caisson body;

wherein the first and second tabs are positioned between the top end and bottom end to permit the vibratory caisson driver receiving the first tab and second tab within the clamp jaws at only one side of the caisson body to raise the caisson from a horizontal position to a vertical position and drive the caisson into the around without repositioning of the vibratory caisson driver; wherein the first and second tabs are fixedly attached to the caisson body at the opposed tube walls so as to transfer force from the vibratory caisson driver through the tabs to the caisson body to drive the caisson into the ground; and wherein the two tabs are joined by a bridging element lying within a plane of the tabs and passing through the first opposed tube wall to be welded thereto.

10. A caisson for vibratory installation comprising:

a caisson body providing a rigid tube extending along an axis between a top end and a bottom end and open at the bottom end and having a cross-sectional area greater than two square feet, the tube having opposed tube walls; and at least one tab removed from the top end and passing diametrically through the rigid tube perpendicular to the axis and attached to the caisson body at the opposed tube walls, the tab extending outward from at least one of the opposed tube walls by a predetermined clamping distance sized for the tab to be received by clamp jaws of a vibratory caisson driver;

further including a reinforcing flange attaching to the rigid tube at an area adjacent to an extension of the tab outward from the at least one of the opposed tube walls to connect to the tab and the at least one of the opposed tube walls;

wherein the reinforcing flanging is welded to an outer surface of the at least one of the opposed tube walls and welded to the tab;

wherein the at least one tab is positioned between the top end and bottom end to permit the vibratory caisson driver receiving the at least one tab within the clamp jaws at only one side of the caisson body to raise the caisson from a horizontal position to a vertical position and drive the caisson into the ground without repositioning of the vibratory caisson driver.

11. The caisson of claim 10 wherein the reinforcing flange surrounds the tab at a point of exit of the tab from the caisson body.

12. The caisson of claim 10 wherein the reinforcing flange curves to conform to a curvature of the at least one of the opposed tube walls.

* * * * *